US007316145B1

(12) United States Patent
Shore

(10) Patent No.: US 7,316,145 B1
(45) Date of Patent: Jan. 8, 2008

(54) MULTIPLE OUTLET ROLLING MILL

(75) Inventor: T. Michael Shore, Princeton, MA (US)

(73) Assignee: Morgan Construction Company, Worcester, MA (US)

( * ) Notice: Subject to any disclaimer, the term of this patent is extended or adjusted under 35 U.S.C. 154(b) by 0 days.

(21) Appl. No.: 11/675,276

(22) Filed: Feb. 15, 2007

(51) Int. Cl.
*B21B 41/00* (2006.01)

(52) U.S. Cl. ..... 72/228; 72/227; 72/250; 72/279; 72/280

(58) Field of Classification Search ..... 72/227, 72/228, 231, 250, 279, 280
See application file for complete search history.

(56) References Cited

U.S. PATENT DOCUMENTS

| | | | | |
|---|---|---|---|---|
| 351,840 | A | 11/1886 | Lenox | |
| 1,935,048 | A | 11/1933 | Gassen | |
| 3,486,359 | A | 12/1969 | Hein | |
| 3,729,972 | A | 5/1973 | Kocks | |
| 3,774,433 | A | 11/1973 | Pauels | |
| 3,942,350 | A | 3/1976 | Brauer et al. | |
| 4,028,920 | A | 6/1977 | Zander | |
| 4,310,031 | A | 1/1982 | Appel et al. | |
| 4,457,154 | A | 7/1984 | Ohba | |
| 4,528,834 | A * | 7/1985 | Aoyagi et al. | 72/202 |
| 5,307,663 | A | 5/1994 | Shore et al. | |
| 5,312,065 | A | 5/1994 | Shore et al. | |
| 5,595,354 | A | 1/1997 | Josoff | |
| 5,893,288 | A | 4/1999 | Shore | |
| 7,021,103 | B2 | 4/2006 | Shore | |
| 7,093,472 | B1 * | 8/2006 | Shore et al. | 72/227 |

FOREIGN PATENT DOCUMENTS

| | | |
|---|---|---|
| EP | 0815973 A1 | 3/2002 |
| JP | 02-2355181 | 9/1990 |
| JP | 5-116845 | 5/1993 |
| JP | 2002-126817 | 5/2002 |

* cited by examiner

*Primary Examiner*—Dmitry Suhol
(74) *Attorney, Agent, or Firm*—Gauthier & Connors, LLP

(57) ABSTRACT

Accumulators are interposed between an initial mill section having an elevated first production rate and each of a plurality of different outlet mill sections having lower second production rates. Each accumulator is constructed and arranged to receive intermediate products from the initial mill section at its elevated first production rate, and to deliver the intermediate products to the associated outlet mill section at its respective lower second production rate. The excess intermediate product resulting from the differential between the first and second production rates is stored temporarily in the accumulator. Switches direct successive intermediate product lengths from the initial mill section to selected outlet mill sections via their respective accumulators for simultaneous processing into packaged finished products.

2 Claims, 4 Drawing Sheets

MULTIPLE OUTLET ROLLING MILL

BACKGROUND

1. Field of the Invention

This invention relates generally to continuous hot rolling mills of the type designed to produce long products.

2. Description of the Prior Art

Conventional rolling mills designed to produce long products typically comprise an initial mill section including a furnace for reheating billets, followed by roughing and intermediate mill stands which roll the thus heated billets into intermediate products having reduced cross-sectional areas. Differently configured outlet mill sections are then employed, selectively and individually, to additionally roll the intermediate products into finished products that are processed into packages according to customer requirements.

The initial mill section has an elevated "first" production rate that in most cases exceeds lower "second" production rates of the individual outlet mill sections. Thus, for the majority of the mill's finished products, the higher first production rate of the initial mill section cannot be realized because the entire mill must be slowed to match the lower second production rate of the outlet mill sections currently in use. The resulting reduced production rate, when coupled with the capital investment in the outlet mill sections that are not currently in use (referred to as "dead money"), amounts to a significant loss to the mill operator.

The objective of the present invention is to provide a means for simultaneously operating multiple different mill outlet sections at a combined production rate that exceeds the second production rates of the individual outlets, and that ideally equals and thus takes maximum advantage of the elevated first production rate of the initial mill section.

SUMMARY OF THE INVENTION

In accordance with the present invention, accumulators are interposed between the initial mill section and each of the outlet mill sections. Each accumulator is constructed and arranged to receive intermediate products from the initial mill section at its elevated first production rate, and to deliver the intermediate products to the associated outlet mill section at its respective lower second production rate. The excess intermediate product resulting from the differential between the first and second production rates is stored temporarily in the accumulator. Switches direct successive intermediate product lengths from the initial mill section to selected outlet mill sections via their respective accumulators for simultaneous processing into packaged finished products.

The foregoing, and related objectives and additional advantages, will now be described with reference to the accompanying drawings, wherein:

DETAILED DESCRIPTION

Figure 3:
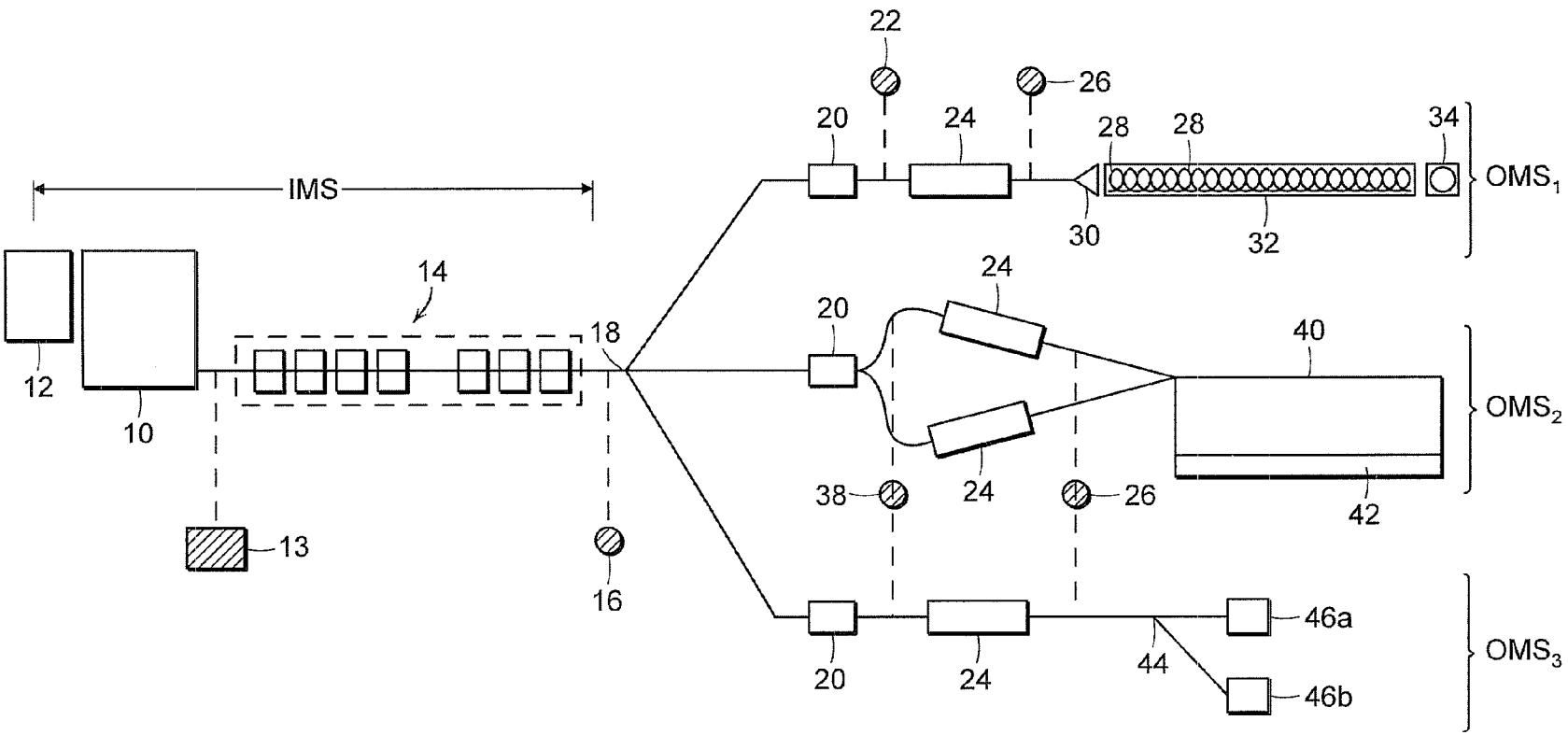
FIG. 3 (PRIOR ART)
FIG. 3 is a schematic view of an exemplary rolling mill layout in accordance with conventional practice.

As shown in FIG. 3, a conventional mill configured to roll long products will include a furnace 10 for reheating billets received from a storage yard 12. A typical billet 13 will have a square cross section measuring 130×130 to 250×250 mm, a length of 5-14 meters, and will weigh about 1,500-4,000 kg. The reheated billets are rolled in a series of roughing and intermediate roll stands (collectively shown at 14) to produce an intermediate product 16, e.g., a round having a diameter of 20-35 mm. The furnace 10 and roughing and intermediate roll stands 14 comprise an initial mill section "IMS" which typically will have a relatively high first production rate on the order of 150 to 360 tons per hour.

A switch 18 serves to selectively direct intermediate products 16 to one of several outlet mill sections $OMS_1$, $OMS_2$, and $OMS_3$. Outlet mill section $OMS_1$ has a processing line with prefinishing roll stands 20 that roll the intermediate product 16 into a round 22 having a reduced diameter of 16-28 mm, and a finishing block 24 which produces a finished product 26 having a diameter of 5-22 mm. The finished product 26 is then subjected to further processing, including formation into rings 28 by a laying head 30, with the rings being received in Spencerian form on a cooling conveyor 32 which conveys the rings to a reforming chamber 34 where they are gathered into upstanding coils. The outlet mill section $OMS_1$ will typically operate at a maximum second production rate of about 70-150 tons per hour.

Outlet mill section $OMS_2$ has a processing line that includes prefinishing roll stands 20 which roll the intermediate product into a so-called "dog bone" section which is then slit into rounds 38 having a reduced diameter of 16-28 mm, and two finishing blocks 24 which roll the rounds 38 into the same 8.0 mm finished products 26. Those finished products are directed to a cooling bed 40 on which lengths are cooled before being collected and strapped into bundles at a bundling station 42. The outlet mill section $OMS_2$ will typically operate at a maximum second production rate of 25-150 tons per hour.

Outlet mill section $OMS_3$ includes a processing line with prefinishing roll stands 20 and a finishing block 24. Here, the finished product, again an 8.0 mm round 26, is directed to a switch 44 which alternately feeds two spoolers 46*a*, 46*b*. The maximum second production rate of outlet mill section $OMS_3$ is also 25-150 tons per hour.

In this conventional mill layout, the outlet mill sections $OMS_1$, $OMS_2$, and $OMS_3$ must be operated individually at their respective second production rates, and cannot be operated simultaneously. Thus, if the initial mill section has a production rate of, say, 300 tons per hour and switch 18 is set to direct an intermediate product length to outlet mill section $OMS_1$, the entire mill must be slowed to the second production rate of that outlet mill section, while the other outlet mill sections $OMS_2$ and $OMS_3$ remain idle. Use of one or the other of outlet mill sections $OMS_2$ and $OMS_3$ will also result in reductions in the mill's production rate below the maximum of the initial mill section.

Figure 1:
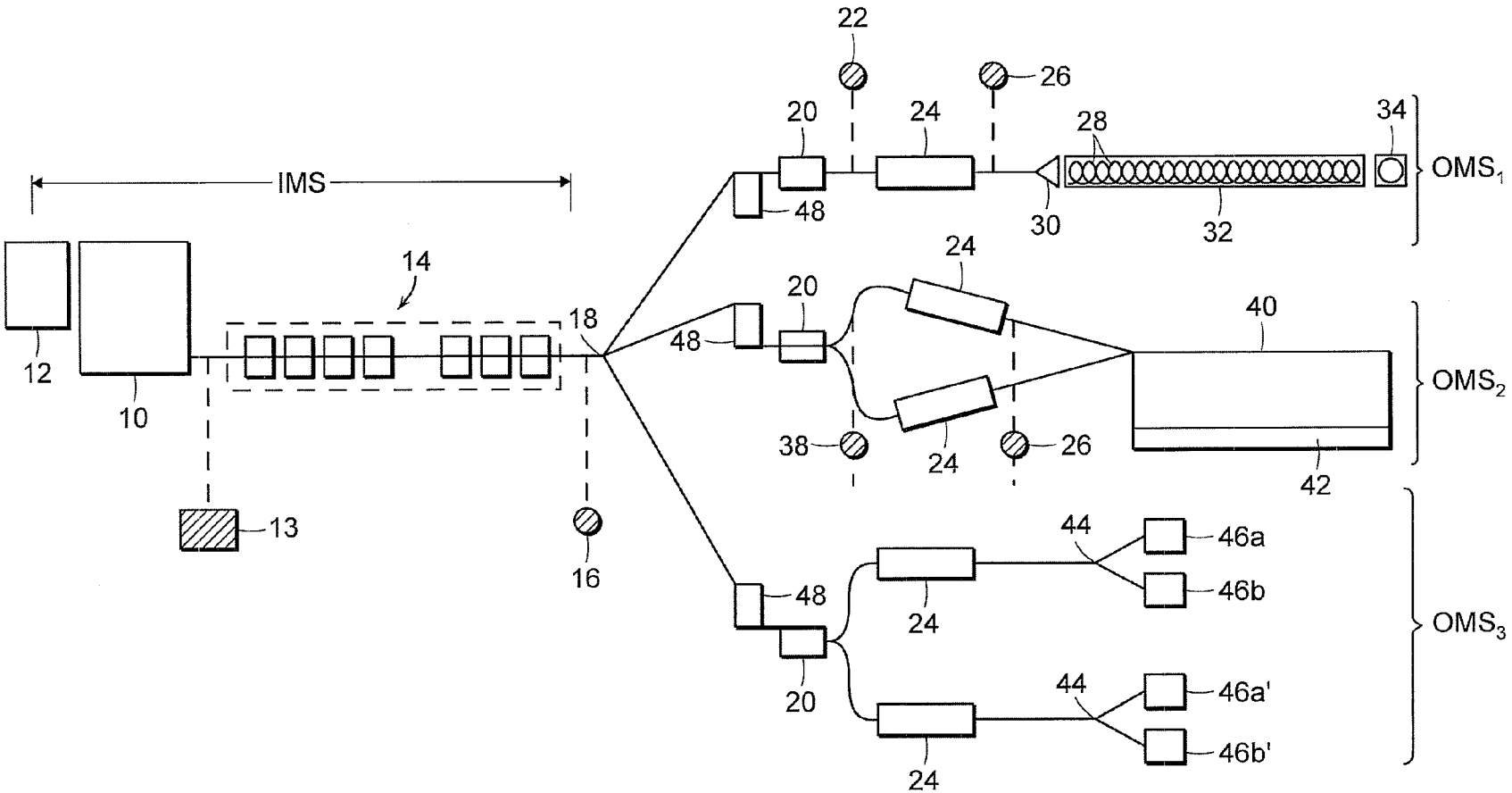
FIGS. 1 and 2 are schematic views of exemplary rolling mill layouts embodying the concepts of the present invention.

In accordance with one embodiment of the present invention, and as shown in FIG. 1, the initial mill section, IMS, remains essentially unchanged. The outlet mill section $OMS_3$ has been reconfigured with a prefinishing roll stand 20 that produces a dog bone section slit into rounds and fed to two finishing blocks 24. The finished products are then directed to switches 44 which alternately feed pairs of spoolers 46*a*, 46*b*. Accumulators 48 have been installed in advance of each outlet mill section. The accumulators are preferably of the type described in U.S. Pat. No. 7,021,103, the description of which is herein incorporated by reference.

Each accumulator 48 is constructed and arranged to receive intermediate products at the production rate of the initial mill section IMS, and to simultaneously deliver the intermediate products to the associated outlet mill section at its reduced production rate, with the excess intermediate product resulting from the differential production rates being stored temporarily in the accumulator.

Figure 4A:
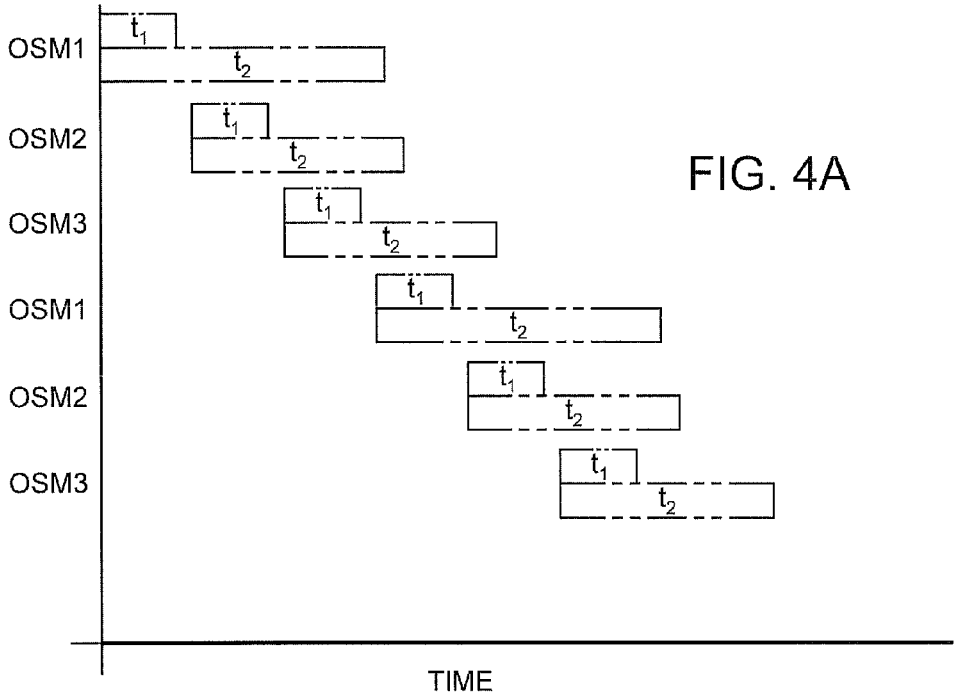
FIGS. 4A and 4B are time diagrams depicting the rolling sequences for the mill layouts shown in FIGS. 1 and 2.

By way of example, assume that in the mill layout shown in FIG. 1, the initial mill section IMS has a production rate of 275 tons per hour, and the outlet mill sections $OMS_1$, $OMS_2$, and $OMS_3$, respectively have production rates of 75, 100, and 100 tons per hour. With reference to FIG. 4A, a typical rolling sequence will begin with an intermediate product length being directed to the accumulator 48 of outlet mill section $OMS_1$. The intermediate product is received at the initial mill section's first production rate of 275 tons per hour, and is simultaneously dispensed from the accumulator to the processing line at its production rate of 75 tons per hour. The differential resulting from the different production rates is stored temporarily on the accumulator. The entire intermediate product length is received on the accumulator at the end of time interval $t_1$, and it is completely processed by the outlet mill section $OMS_1$ at the end of time interval $t_2$.

As soon as a full intermediate product length is received on the accumulator of $OMS_1$, the next product length is directed to the accumulator of $OMS_2$. This stepped process is continued to $OMS_3$. By the time that the accumulator of $OMS_3$ has received a full intermediate product length, the accumulator of $OMS_1$ is empty and ready to receive the next product length. It thus will be seen that by sequentially employing multiple outlet mill sections, made possible by the interposition of accumulators 48, the mill can be operated continuously at its maximum production rate of 275 tons per hour.

Figure 2:
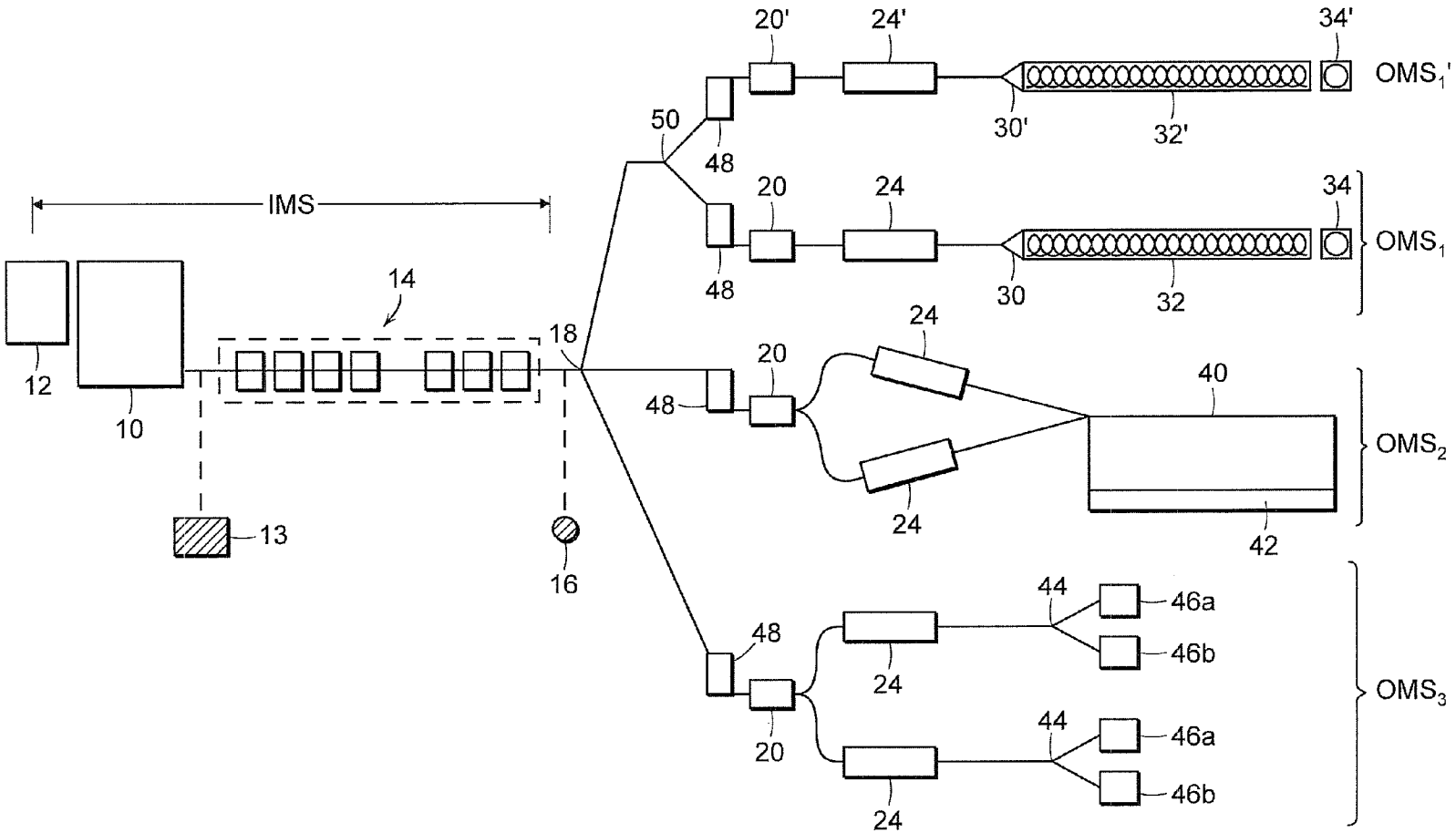

FIG. 2 illustrates a mill layout similar to FIG. 1, with the addition of outlet mill section $OMS_1'$ and a switch 50 to selectively feed one or the other of $OMS_1'$ and $OMS_1$. Here, the production rate of the initial mill section IMS is increased to 350 tons per hour.

Figure 4B:
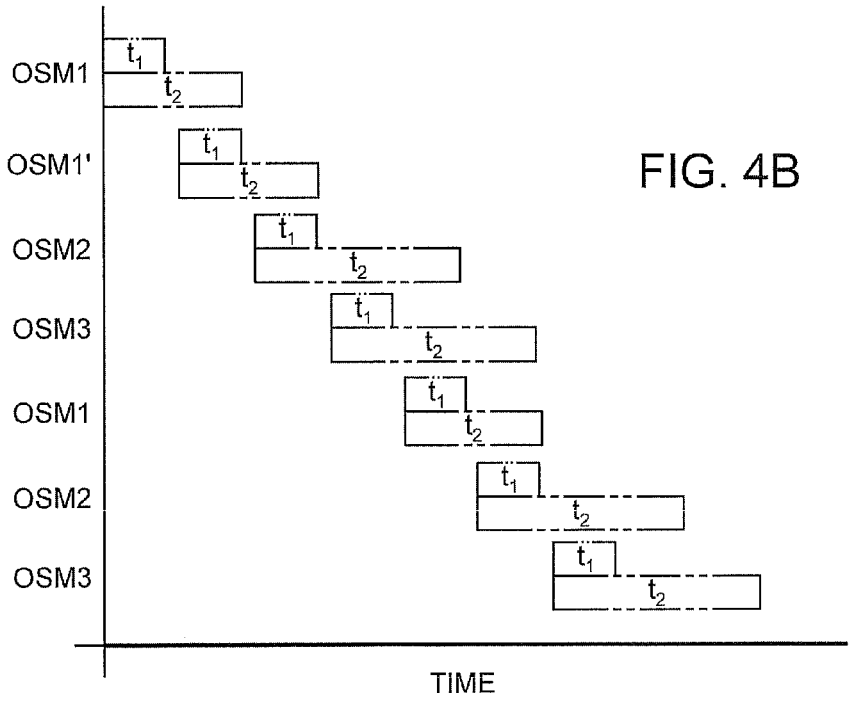

FIG. 4B illustrates a typical rolling sequence for the layout of FIG. 2. Here again, the stepped rolling sequence makes it possible to roll continuously at the maximum production rate of the initial mill section.

I claim:

1. A rolling mill comprising:

an initial mill section configured and arranged to reheat and continuously roll billets into intermediate product at a first production rate;

multiple differently configured outlet mill sections constructed and arranged to additionally roll said intermediate products into finished products that are processed into packages at second production rates that are lower than said first production rate, the forms of the packages produced by at least some of said outlet mill sections being different from the forms of packages produced by other of said outlet mill sections;

accumulators interposed between each of said outlet mill sections and said initial mill section, each of said outlet mill section, each of said accumulators being configured and arranged to receive said intermediate products at said first production rate while simultaneously delivering said intermediate products to the associated outlet mill section at its respective second production rate, with the excess intermediate products resulting from the differential between said first and second production rates being stored temporarily in said accumulators; and switch means for receiving successive lengths of said intermediate products from said initial mill section and for selectively directing said intermediate products to selected outlet mill sections via their respective accumulators for processing into finished products.

2. The rolling mill of claim 1 wherein at least some of said outlet mill sections are operable simultaneously at second production rate which collectively equal said first production rate.

* * * * *

UNITED STATES PATENT AND TRADEMARK OFFICE

CERTIFICATE OF CORRECTION

PATENT NO. : 7,316,145 B1
APPLICATION NO. : 11/675276
DATED : January 8, 2008
INVENTOR(S) : T. Michael Shore It is certified that error appears in the above-identified patent and that said Letters Patent is hereby corrected as shown below:

In Column 4, claim 1, line 10, delete “product” and replace with “products”

In Column 4, claim 1, lines 21-22, delete “each of said outlet mill section,”

In Column 4, claim 2, line 39, delete “rate” and replace with “rates”

Signed and Sealed this

Twentieth Day of January, 2009

JON W. DUDAS
*Director of the United States Patent and Trademark Office*